United States Patent [19]

Oakes

[11] 4,147,020

[45] Apr. 3, 1979

[54] COMMINGLING AIR JET DEFLECTOR

[75] Inventor: Ralph C. Oakes, Toccoa, Ga.

[73] Assignee: Milliken Research Corporation, Spartanburg, S.C.

[21] Appl. No.: 916,121

[22] Filed: Jun. 16, 1978

[51] Int. Cl.[2] ..... D02G 1/16; D01H 7/90

[52] U.S. Cl. ..... 57/289; 28/271; 57/350; 57/908

[58] Field of Search ..... 57/34 R, 34 B, 77.3, 57/78, 80, 106, 157 F; 28/247, 271, 273, 274

[56] References Cited

U.S. PATENT DOCUMENTS

| | | | |
|---|---|---|---|
| 3,005,251 | 10/1961 | Hallden et al. | 57/34 B |
| 3,453,709 | 7/1969 | Dyer | 28/273 X |
| 3,706,192 | 12/1972 | Leibbrand et al. | 57/34 B X |
| 4,011,640 | 3/1977 | Keith | 28/274 |

*Primary Examiner*—Donald Watkins

*Attorney, Agent, or Firm*—Earle R. Marden; H. William Petry

[57] ABSTRACT

An air jet nozzle to entangle the filaments of at least a pair of multifilament yarns passing therethrough. Air is supplied substantially perpendicular to the yarn passing through the jet and an air deflector is employed on the entrance side of the jet to prevent the supplied air from blowing residue from the yarn into the yarn break detector switches.

5 Claims, 3 Drawing Figures

COMMINGLING AIR JET DEFLECTOR

In the false twisting of continuous filament synthetic yarn by the use of friction discs, a residue is rubbed off the yarn which tends to collect on the false twist machinery. When this false twisted yarn is commingled with another false twist yarn in an air jet, the air being supplied to the jet tends to blow some of this residue onto the cutter activating switches causing them to malfunction and not detect a broken end. When this happens, a single end yarn is produced which causes seconds in the fabric produced by such yarns.

Therefore, it is an object of the invention to commingle a plurality of yarns in an air jet and prevent the air from the jet from blowing yarn residue on the cutter activating switches.

Other objects and advantages of the invention will become readily apparent as the specification proceeds to disclose the invention, in which.

Figure 1:
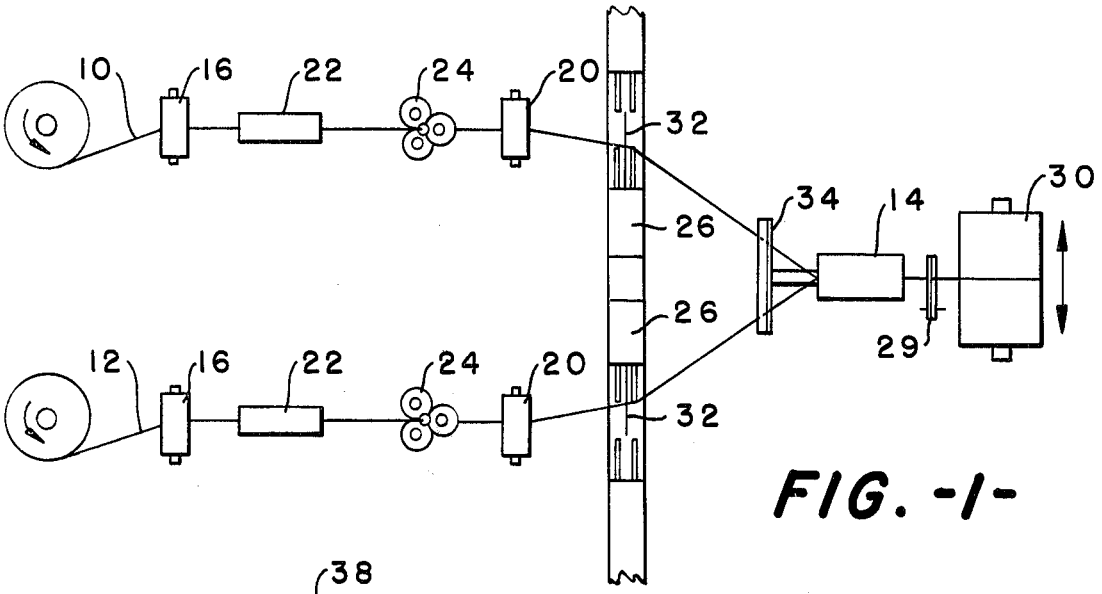
FIG. 1 shows a single continuous process for texturing two strands of multifilament yarn and entangling same in an air jet nozzle.
Figure 3:
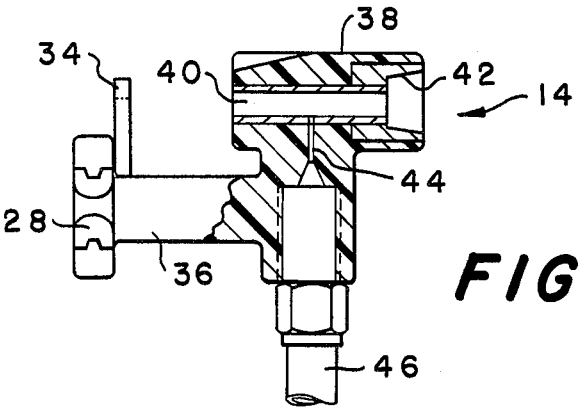
FIG. 3 is a partially cross-section of an air entanglement nozzle.
Figure 2:
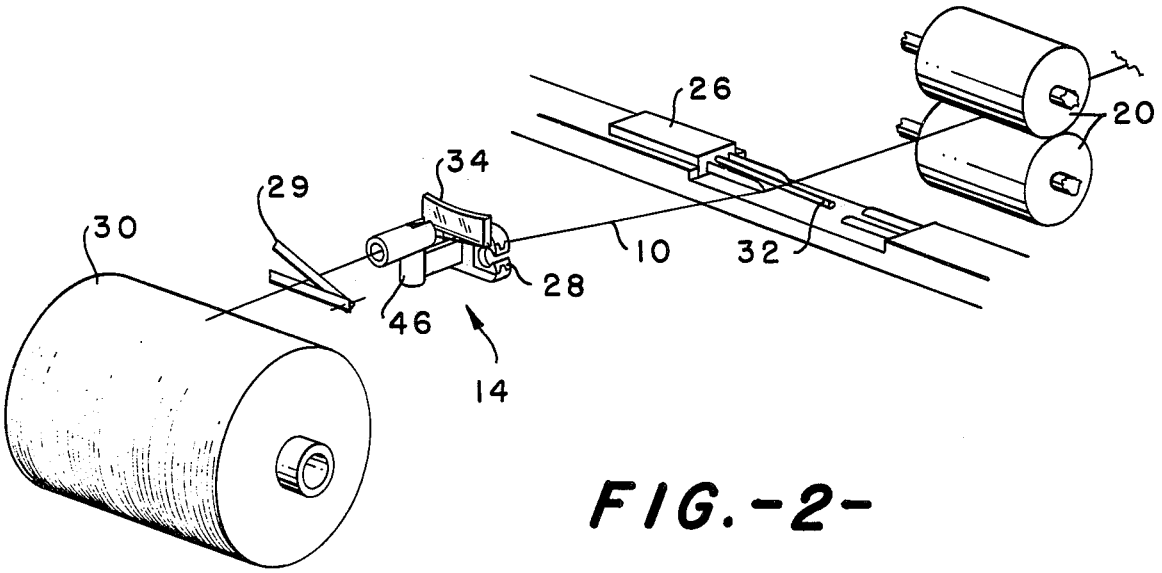
FIG. 2 shows a blown-up, perspective view of a single strand of yarn being supplied to an air entanglement nozzle.

Looking now to FIGS. 1 and 2, the reference numerals 10 and 12 refer to continuous synthetic multifilament yarns which are being supplied to the air entangling jet nozzle 14 through a conventional false twist zone by driven nip rolls 16 and 20. In conventional manner, each of the false twist zones employ a heating tube 22 and a conventional friction disc false twist device 24. From the false twist devices 24 each of the yarns pass over a cutter activating switch 26 and through ceramic guide eyelets 28 into the air entangling nozzle 14 to be commingled or entangled. From the nozzle 14 the commingled yarn passes through a cutting device 29 and is taken-up on the take-up package 30. The cutting device 29 is automatically controlled by either of the switches 26 to cut the yarn to the take-up package if either of the contacts 32 of switches 26 is allowed to rise due to the absence of a yarn end thereover. The rising of the contact 32 makes the circuit to the cutting device 29 to cut the yarn and prevent the winding of a single end of yarn.

The air jet commingling nozzle 14 is shown partially in section in FIG. 2 and consists basically of a pair of ceramic guide eyelets 28, and air deflector shield 34, a support bar 36 and the nozzle body 38. The nozzle body 38 basically consists of a passage therethrough lined by a metal cylinder 40, a metallic outlet collar 42 and an air passage 44 substantially perpendicular to the center line of the cylinder 40 and supplied air under pressure from conduit 46.

In the false twisting of synthetic yarns, especially when using friction discs, a residue is rubbed off the surface of the yarn and tends to be carried with the yarn. In the use of the air jet nozzle 44, the supplied air, not only blows out of the front of the nozzle 14 but also blows in the rearward direction carrying the above mentioned yarn residue. Prior to this invention some of this residue was blown on and accumulated on the cutter activating switches 26 causing them to stick and malfunction. To prevent this malfunction of the switches 26 the air deflector shield 34 is employed to prevent the yarn residue from being blown onto the switches 26 so that upon the breakage of one of the yarns 10 or 12 the cutter 29 will be activated to cut the yarn to the take-up package and thereby prevent winding of a single end of yarn.

It can be seen that the new and novel air jet entangling nozzle prevents the build-up of yarn residue on the yarn breakage detector switches thus allowing the yarn breakage detector switches to function properly to activate the yarn cutter device.

I claim:

1. In a yarn processing machine having a means to friction false twist a plurality of multifilament, synthetic yarns and an air jet entangling nozzle to entangle at least two of the friction false twisted yarns, the improvement comprising a yarn end break detector means mounted between said means to false twist yarns and said nozzle and an air deflector located between said yarn break detector means and said air nozzle to prevent air from said air nozzle from blowing yarn residue on said yarn break detector means.

2. The machine of claim 1 wherein said air deflector is mounted adjacent the entrance end of said air nozzles.

3. The method of commingling at least two friction false twisted synthetic, multifilament yarns comprising the steps of: passing each of the yarns over a yarn breakage detection device, supplying each of the yarns into a passage in an air jet nozzle, supplying air into the air jet nozzle substantially perpendicular to the centerline of the passage in the air jet nozzle to entangle the filaments of the yarn, preventing the air from said air jet nozzle from blowing directly onto the yarn breakage detection device and taking up the entangled yarn from the air jet nozzle.

4. An air jet entangling nozzle comprising: a body portion, means forming a passage through said body portion, said passage having an entrance and an exit, with the diameter of the passage at the entrance being smaller than the diameter of the passage at the exit, a support member projecting from the entrance end of the portion, an air deflector operably associated with said support member, means forming an air opening in said body portion substantially perpendicular to the centerline of said passage and means supplying air under pressure to said air opening.

5. The nozzle of claim 4 wherein a pair of yarn guides are mounted on said support member adjacent said air deflector.

* * * * *